United States Patent [19]

Massa

[11] 4,433,399

[45] Feb. 21, 1984

[54] ULTRASONIC TRANSDUCERS

[75] Inventor: Frank Massa, Cohasset, Mass.

[73] Assignee: The Stoneleigh Trust, Cohasset, Mass. ; Fred M. Dellorfano, Jr. and Donald P. Massa, Trustees

[21] Appl. No.: 315,640

[22] Filed: Oct. 28, 1981

Related U.S. Application Data

[63] Continuation-in-part of Ser. No. 54,812, Jul. 5, 1979, abandoned.

[51] Int. Cl.[3] ..... H04R 17/00

[52] U.S. Cl. ..... 367/157; 310/337

[58] Field of Search ..... 367/153–176, 367/140, 141; 134/1, 184; 366/115, 127; 310/26, 334, 335, 337, 369

[56] References Cited

U.S. PATENT DOCUMENTS

| | | | |
|---|---|---|---|
| 2,138,036 | 11/1938 | Kunze | 310/337 |
| 2,592,703 | 4/1952 | Jaffe | 367/163 X |
| 2,775,434 | 12/1956 | Probst | 310/337 |
| 3,027,540 | 3/1962 | Howatt | 310/337 |
| 3,464,672 | 2/1969 | Massa | 366/115 |
| 3,715,713 | 2/1973 | Massa | 367/164 |
| 3,847,662 | 11/1974 | Massa | 367/165 |
| 3,858,065 | 12/1974 | Epstein | 310/369 |
| 4,100,527 | 7/1978 | Tocquet | 367/166 |
| 4,107,790 | 8/1978 | McCord | 366/127 |
| 4,151,437 | 4/1979 | Tocquet | 310/337 |

FOREIGN PATENT DOCUMENTS

| | | | |
|---|---|---|---|
| 585969 | 11/1958 | Italy | 366/127 |

*Primary Examiner*—Harold J. Tudor

[57] ABSTRACT

An improved ultrasonic transducer that can be used for cleaning the inner wall surface of water-filled tank, such as a toilet bowl, employs a ceramic disc operating in the planar resonant frequency mode in combination with an acoustic transmission line comprising a solid washer-like annulus bonded to the periphery of the ceramic. The radial dimension of the annulus is made equal to approximately one-half wavelength of sound in the material at the frequency of operation. The annulus serves as an acoustic transmission line to extend the peripheral vibrating surface of the ceramic so that the acoustic power is transferred from the periphery of the ceramic disc to a region closer to the inner wall surface of the tank. The transmission line also increases the radiating area of the transducer element which achieves increased sonic power density in the vicinity of the wall surface.

10 Claims, 2 Drawing Figures

ULTRASONIC TRANSDUCERS

This invention is a continuation-in-part of application Ser. No. 54,812, filed July 5, 1979, now abandoned, and is concerned with improvements in transducers for use in ultrasonic cleaning applications and more specifically in ultrasonic cleaning applications in which the ultrasonic power output from the transducer is efficiently transmitted over a novel acoustic transmission line to be put in closer proximity to the inside wall surface of a tank whose total surface area to be cleaned is much larger than the area of the transducer vibratile element without the transmission line.

In prior art ultrasonic systems which have been successfully used for ultrasonic cleaning applications, the area of the vibratile surface of the transducer employed in the cleaner has generally been a large fraction of the area of the surface of the structure being cleaned. A particularly effective ultrasonic cleaner is illustrated in FIG. 1 of U.S. Pat. No. 3,464,672 which shows a cylindrical transducer element 12 whose radially vibrating surface is coupled to the outer surface of a cylindrical cup which contains the cleaning liquid within which the article to be cleaned is immersed. One reason for the successful cleaning achieved by this type of prior art design is due to the configuration and relatively large area of the transducer vibratile surface compared with the total size of the cleaning container which results in intense cavitation throughout the entire volume of the liquid. If, on the other hand, an ultrasonic transducer employing a radially vibrating ring or disc to generate acoustic radiation from its peripheral edge surface were located along the center line of a tank whose diameter is appreciably larger than the diameter of the transducer element, and the radial vibrations from the transducer element were used directly for generating acoustic power in the liquid for ultrasonically cleaning the inner wall surface of the tank, the cleaning action would not be very efficient because the ultrasonic power level generated near the peripheral edge of the transducer element surface would diminish rapidly as the distance from the peripheral surface of the transducer element to the wall of the tank increases. Also, the high cavitation level generated near the vibratile surface of the transducer element would cause gas bubbles to be released from the liquid as it is torn apart by the cavitation forces, and the presence of the gas released from the liquid would greatly attenuate the transmission of the sound energy throughout the liquid, with the consequence that ineffective cleaning would take place at the wall surface of the tank. The inventive transducer design employs a solid washer-shaped acoustic transmission line bonded to the periphery of the radially vibrating transducer element to efficiently extend the peripheral radiating surface of the transducer element so that the high cavitation level is brought in closer proximity to the wall surface of the tank being cleaned.

The primary object of this invention is to improve the design of an ultrasonic transducer so that it can more efficiently clean the inner wall surface of a tank radial dimensions are appreciably larger than the radial dimension of the vibratile transducer element.

Another object of the invention is to design a transducer for use in ultrasonic cleaning and to increase its capability for generating high intensity cavitation sound pressure levels in a liquid by increasing the effective vibratile surface area of the transducer and bringing the increased vibratile surface area in closer proximity to the inner wall surface of the tank which is being cleaned.

Still another object of the invention is to provide a transducer with an annular, washer-shaped solid transmission line which is acoustically coupled to the periphery of a radial vibrating transducer element for the purpose of extending the effective diameter of the vibratile surface of the transducer element to bring it in closer proximity to the inner wall surface of a tank within which the transducer is immersed.

Additional objects will become more apparent to those skilled in the art by the description of the invention which follows, when taken with the accompanying drawings in which.

Figure 1:
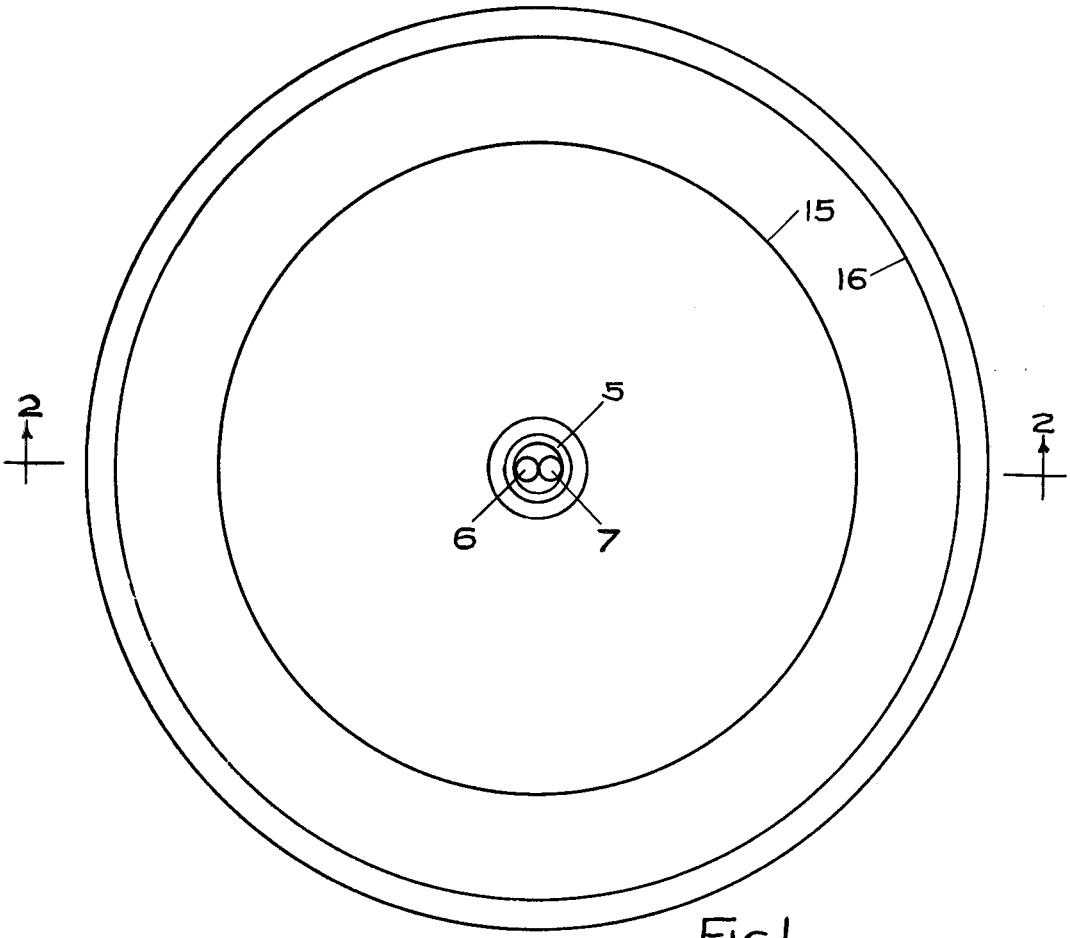
FIG. 1 is a plan view of a cylindrical tank containing a liquid within which a radially vibrating transducer employing one illustrative embodiment of this invention is immersed.
Figure 2:
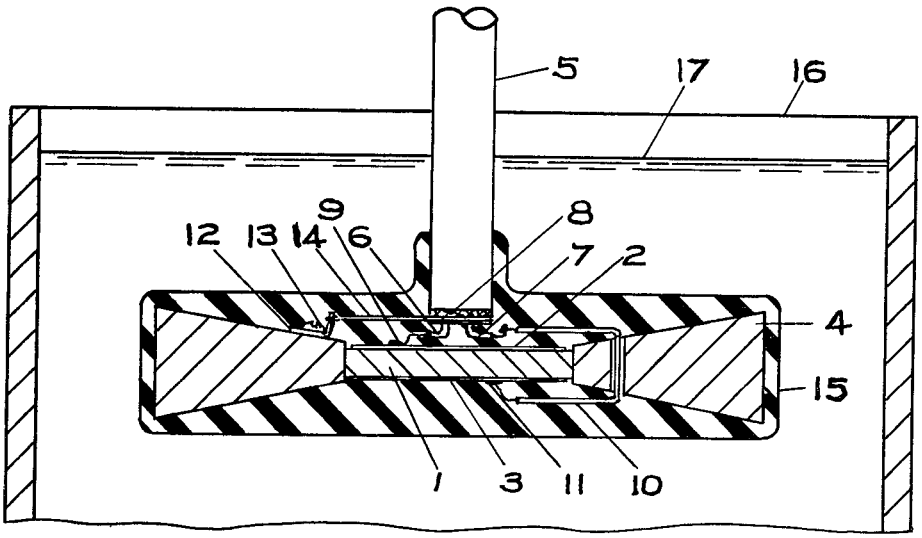
FIG. 2 is a section taken along the line 2—2 of FIG. 1.

Referring more particularly to the figures, FIGS. 1 and 2 illustrate one preferred form of this invention which employs a radially vibrating transducer element comprising a polarized ceramic disc 1, shown in cross section in FIG. 2. The ceramic element may be, for example, a disc of lead zirconate titanate with metallic electrodes 2 and 3 applied to the opposite flat surfaces in the conventional manner, as is well known in the art. The ceramic disc is operated preferably in the planar resonant frequency mode and in order to extend the peripheral vibrations of the ceramic disc to a region of larger diameter, an acoustic transmission line comprising a washer-like solid annulus 4 is acoustically coupled to the periphery of the ceramic disc 1, as illustrated. As is well known in the art and as is defined in this invention, the length of the transmission line, which is represented by the radial dimension of the annulus 4, is made greater than the thickness dimension of the annulus. The annulus 4 is preferably tapered, as shown in FIG. 2, such that the thickness dimension at the outer periphery of the annulus is increased so that improved acoustic loading by the liquid 17 occurs when the transducer is operating. As is well known in the art, the thickness dimension at the outer periphery of said transmission line is preferably made greater than $\frac{1}{4}$ wavelength of the sound generated by the transducer in the liquid.

The length of the transmission line, which is the radial dimension of the annulus 4 shown in FIG. 2, is preferably made approximately equal to one-half wavelength of sound in the annulus material at the frequency of operation of the transducer. As is well known in the art, the optimum value of the radial dimension is dependent on the ratio of the acoustic impedance of the transmission line material to the acoustic impedance of the liquid into which the transducer is operating. The higher the impedance ratio, the closer the radial dimension becomes equal to one-half wavelength of sound in the material at the operating frequency. In general, for liquids such as water and for transmission line materials such as aluminum or steel, the optimum length of the transmission line is somewhat less than one-half wavelength. However, from a practical standpoint, since the transmission line efficiency changes slowly as the length of the transmission line varies from the exact theoretical optimum value, it is a simple design procedure to select the physical dimension of the transmission line to be in the general vicinity of the theoretical one-half wavelength dimension in the material and then adjust the operating frequency to optimize the acoustic output of the transmission line while operating the structure in the actual liquid environment. It is also preferable to select the diameter of the ceramic disc so that the planar resonant frequency of the ceramic disc corresponds to the desired frequency of operation of the transmission line annulus 4 in order to optimize the transfer of the radial vibrations from the periphery of the ceramic disc to the outer periphery of the annulus.

Although the preferred embodiment illustrated in FIG. 2 employs a ceramic disc operating in the planar resonant frequency mode it is possible to substitute the disc by a ceramic ring operating in the circumferential resonance mode. In other words, if a hole is cut through the center of the disc 1, the remaining outer ring portion of the disc operating in the circumferential resonant mode can be used as an alternative to the solid disc 1 shown in FIG. 2. Obviously the resonance frequency of the ring will be different than the resonance frequency of the disc of the same diameter, as is well known in the art. Therefore, the diameter of the ring will have to be selected accordingly to achieve the desired frequency of operation for the transducer.

In order to maintain good acoustic coupling between the periphery of the ceramic and the internal diameter of the annulus, a preferred design is to provide an interference fit between the mating parts. At assembly, the annulus is heated to cause the thermal expansion of the material to increase the diameter of the hole in the annulus sufficient for the annulus to fit over the ceramic and then become tightly engaged upon cooling. In order to advantageously provide an optimum positive compressive stress bias on the ceramic, the interference dimension between the opening in the annulus and the periphery of the ceramic should be chosen so that, upon cooling of the annulus after assembly, the compressive stress in the ceramic disc remains in the approximate range 2000–4000 psi. A thin cement film is preferably applied between the joined surfaces of the annulus and the ceramic to fill any slight imperfections between the mating surfaces which would otherwise deteriorate the acoustic coupling between the periphery of the disc and the mating surface of the annulus.

After attaching the annulus-shaped transmission line 4 to the periphery of the ceramic, a waterproof cable 5 with two insulated conductors 6 and 7 and a shield 8 is connected to the structure, as illustrated in FIG. 2. A flexible lead 9 is soldered to the tip of the conductor 6 and to the surface of the electrode 2 as shown. An insulated flexible conductor 10 is passed through a hole drilled into the annulus 4, as illustrated, and one end of the conductor is soldered to the tip of the conductor 7. The opposite end of the conductor 10 is attached to the electrode 3 by means of the solder 11. A terminal lug 12 is attached to the annulus 4 by means of the screw 13. An electrical connection is made by soldering one end of the conductor 14 to the terminal 12 and by soldering the opposite end of the conductor 14 to the cable shield 8, as illustrated in the drawing.

After completing the assembly of the mechanical structure, a sound-conducting rubber-like waterproof housing 15 is molded or potted over the assembly, making a complete waterproof unit. The completed transducer, as illustrated, is shown immersed in a liquid 17 which is contained in the tank 16. The tank 16, for example, could be a toilet bowl whose internal surface would be ultrasonically cleaned by lowering and raising the transducer within the water-filled bowl. By extending the vibrating peripheral surface of the ceramic 1 by the use of the annular transmission line 4, the objectives of this invention are achieved. The cavitating surface of the novel transducer assembly is brought into closer proximity to the inner wall surface of the tank 16 and the area of the cavitating surface of the transducer is also effectively increased, thereby greatly improving the sonic cleaning process over what would otherwise be achieved with the ceramic operating without the transmission line extension.

Although the improved transducer has been described in connection with its principal intended application, namely, for achieving improvements in ultrasonic cleaning of the wall surface of a tank containing a liquid, the novel transducer may also be used advantageously in other applications. It will also be obvious to those skilled in the art that numerous departures may be made from the details shown. For example, the ceramic transducer element can be replaced by a laminated magnetostrictive ring to generate the ultrasonic vibrations. Therefore, the invention should not be limited to the specific equipment shown herein. Quite the contrary, the appended claims should be construed to cover all equivalents falling within the true spirit and scope of the invention.

I claim:

1. In combination in an electroacoustic transducer adapted for generating sound in a liquid, a vibratile transducer element having a circular peripheral vibratile surface, an acoustic transmission line comprising a metallic washer-shaped structure with a center circular opening and characterized in that the radial dimension of said washer-shaped transmission line is greater than the thickness dimension of said transmission line, means for bonding said circular peripheral vibratile surface of said transducer element to the periphery of the circular opening in said acoustic transmission line, electrical terminal means connected to said transducer element for receiving alternating current electrical signals to operate said transducer element and a sound conducting rubber-like waterproof housing molded or potted to completely enclose said vibratile transducer element and said transmission line.

2. The invention in claim 1 characterized in that said vibratile transducer element is a polarized ceramic disc.

3. The invention in claim 2 further characterized in that the frequency of the alternating current supplied to said polarized ceramic disc is in the vicinity of the planar resonance frequency mode of said ceramic disc.

4. The invention in claim 3 characterized in that the radial dimension of said washer-shaped acoustic transmission line is made equal to approximately one-half wavelength of the sound transmitted in the material at the planar resonance frequency of the ceramic disc.

5. The invention in claim 1 characterized in that the radial dimension of said washer-shaped acoustic transmission line is made equal to approximately one-half wavelength in the material at the frequency of operation of the transducer.

6. The invention in claim 1 characterized in that said means for bonding includes an interference fit between the circular peripheral surface of said transducer element and the periphery of the circular opening in the washer-shaped transmission line.

7. The invention in claim 6 further characterized in that a cement is applied between the circular mating surfaces to fill any slight imperfections that may exist between the two mated surfaces.

8. The invention in claim 6 further characterized in that the interference dimensions are made such that, upon assembly, a compressional bias stress will be maintained in the ceramic material within the approximate range 2000–4000 psi.

9. The invention in claim 1 characterized in that the thickness dimension at the outer periphery of said acoustic transmission line is greater than the thickness dimension at the periphery of the circular opening in said transmission line.

10. The invention in claim 9 further characterized in that the thickness dimension at the outer periphery of said transmission line is greater than $\frac{1}{4}$ wavelength of the sound generated by the transducer in the liquid within which the transducer is operated.

* * * * *